US005724761A

United States Patent [19]

Bergacker

[11] Patent Number: 5,724,761

[45] Date of Patent: Mar. 10, 1998

[54] FIREARM BARREL MUZZLE PORTION MOUNTED COMPLETE FIREARM SIGHT AND MOUNT

[76] Inventor: John W. Bergacker, 1009 Northeast 104th St., Miami Shores, Fla. 33138

[21] Appl. No.: 736,054

[22] Filed: Oct. 22, 1996

[51] Int. Cl.[6] ..... F41G 1/41

[52] U.S. Cl. ..... 42/100; 42/103

[58] Field of Search ..... 42/100, 103, 101; 33/241; 89/1-61, 37.01

[56] References Cited

U.S. PATENT DOCUMENTS

| | | | |
|---|---|---|---|
| 3,914,873 | 10/1975 | Elliott, Jr. et al. | 33/241 |
| 4,531,321 | 7/1985 | Bechtel | 42/1 ST |
| 5,052,801 | 10/1991 | Downes, Jr. et al. | 356/153 |
| 5,223,650 | 6/1993 | Finn | 42/101 |
| 5,425,191 | 6/1995 | Taylor et al. | 42/101 |
| 5,471,777 | 12/1995 | McDonald | 42/103 |
| 5,531,039 | 7/1996 | Gore | 42/101 |
| 5,590,486 | 1/1997 | Moore | 42/103 |

*Primary Examiner*—Charles T. Jordan
*Assistant Examiner*—Meena Chelliah
*Attorney, Agent, or Firm*—Michael W. York

[57] ABSTRACT

A firearm sight and mount for use on the muzzle end portion of a firearm barrel. The firearm sight is an optical sight with an artificially illuminated reticle and it and the associated mount are adapted to be rapidly attached to and removed from the muzzle end portion of a firearm barrel without requiring any modification to the firearm barrel. The sight mount has provisions for not marring the finish of the firearm barrel. Both the sight and the mount are made from light weight materials including plastic lenses in the sight and their weights are strictly controlled. The sight and mount increase the ability of the shooter to accurately and rapidly sight the firearm at both moving and stationary targets. A wide variety of reticles can be used such as those that are externally illuminated and self illuminating.

7 Claims, 3 Drawing Sheets

FIREARM BARREL MUZZLE PORTION MOUNTED COMPLETE FIREARM SIGHT AND MOUNT

BACKGROUND OF THE INVENTION

Proper sights on firearms are essential for accurate shooting with the firearm. The firearm, such as a rifle or shotgun, can be inherently very accurate due to various factors and yet if the sights on the firearm are not effective, the firearm will not shoot accurately regardless of how accurate the firearm is that has the inaccurate or ineffective sights, bearing in mind, of course, that some sights are easier to use by some shooters than others.

Typically, firearms will have both a front sight that is located on the firearm barrel near the muzzle of the barrel and a rear sight that is located near the rear or breech end of the barrel or on the receiver or breech portion of the firearm. These sights are commonly referred to as iron sights. In order to shoot the firearm accurately, the shooter must then correctly line up the front sight and the rear sight as well as lining the sights up with the intended target. This takes a large amount of practice to do it properly and even then this sighting process takes time and hence does not lend itself well to shooting at moving targets or to shooting rapidly. These problems are aggravated in the case of an older shooter whose eyes have lost their ability to focus at various distances such as a shooter who needs bifocal corrective eyeglass lenses to see properly. With such shooters either one or more of the sights will not be distinct and clear or the target may be blurry or not distinct. These problems are also aggravated in the case of novice shooters and shooters that do not practice enough to become accurate shooters.

Part of these problems associated with the so called iron sights, have been taken care of with the telescopic sight that has a reticle and optics that usually provide magnification located within a tube that is mounted above the breech end of the firearm that could be the rear portion of the barrel or the firearm receiver. With the telescopic sight it is not necessary to align two sights on the firearm. Instead, it is only necessary to place the reticle on the target. However, the telescopic sight requires a mount for mounting the telescope to the firearm and a telescope mount creates other problems.

The telescope and its mount obviously add weight to the firearm, but more importantly it raises the line of sight higher and farther away from the firearm barrel bore axis than it would be if iron sights were used. This causes several problems. First, with rifles and shotguns the higher line of sight means that the shooter's head must be higher on the stock of the firearm to be able to properly sight through the telescope. This means that the stock must have a cheek rest that is properly positioned to raise the shooter's head enough to properly sight through the telescope. In many cases this will mean that the standard or factory stock will have to be replaced with the associated expense and inconvenience.

In addition, for both rifles and shotguns and other such small arms firearms, the higher line of sight above the bore axis means that it is more difficult to adjust the sight for shooting at a variety of ranges with one sight setting or even with minor adjustments. Also, the higher line of sight means that any canting of the rifle, shotgun, or other small firearm, will result in greater inaccuracy than would be the case if iron sights were used. Another problem with a telescopic sight is that it may strike the eye of the shooter when the firearm recoils if it is not properly mounted for that shooter. Also for the novice or beginner shooter, alignment on the target with iron sights and conventional telescopic sights is more difficult than sighting with this invention.

These problems associated with iron sights and conventional telescopic sights have been overcome with the present firearm barrel muzzle portion mounted complete or unitary firearm sight and mount invention. With this invention there is no requirement to align or line up a plurality of sight elements and the invention does not add significantly to the weight of the firearm. This invention also does not significantly raise the line of sight above the bore axis more than would be the case with iron sights and there is also no problem with the sight striking the eye of the shooter. With the present invention it is possible to accurately and rapidly sight a firearm such as a rifle, shotgun, or carbine or other small arm firearm with ease and at a more rapid rate than with previous firearm sights. This invention can also easily be placed on and removed from a wide variety of small arm firearms without requiring modification of the firearm.

SUMMARY OF THE INVENTION

This invention relates to firearm sights and mounts for small arms and more particularly to a complete firearm sight and mount.

It is an object of the invention to provide a firearm muzzle end portion complete sight and mount that increases the ability to rapidly sight the firearm.

It is an object of the invention to provide a firearm muzzle end portion complete sight and mount that increases the accuracy of the firearm.

It is an object of the invention to provide a firearm muzzle end portion complete sight and mount that is particularly suitable for accurate sighting at moving targets.

It is an object of the invention to provide a firearm muzzle end portion complete sight and mount that has an artificially illuminated reticle.

It is an object of the invention to provide a firearm muzzle end portion complete sight and mount whose sight can use a variety of illuminated reticles.

It is an object of the invention to provide a firearm muzzle end portion complete sight and mount that has an artificially illuminated reticle with an energy source for producing illumination of the reticle.

It is an object of the invention to provide a firearm muzzle end portion complete sight and mount that has an artificially illuminated reticle with an energy source for producing illumination of the reticle that is external from the reticle.

It is an object of the invention to provide a firearm muzzle end portion complete sight and mount that has an artificially illuminated reticle with an energy source for producing illumination of the reticle that is located on or forms part of the reticle.

It is an object of the invention to provide a firearm muzzle end portion complete sight and mount that is extremely light in weight.

It is an object of the invention to provide a firearm muzzle end portion complete sight and mount that is extremely light in weight that uses light weight plastic materials.

It is an object of the invention to provide a firearm muzzle end portion complete sight and mount that is easy to mount on a wide variety of firearms.

It is an object of the invention to provide a firearm muzzle end portion complete sight and mount that is easy to mount on a wide variety of firearms that is capable of being mounted on a firearm barrel that has an existing front sight without removing the existing front sight.

It is an object of the invention to provide a firearm muzzle end portion complete sight and mount that is easy to remove from the firearm.

It is an object of the invention to provide a firearm muzzle end portion complete sight and mount that does not require modification of the firearm for installation.

It is an object of the invention to provide a firearm muzzle end portion complete sight and mount that does not damage or mar the finish of the firearm on which it is installed.

It is an object of the invention to provide a firearm muzzle end portion complete sight and mount that does not unbalance the firearm.

It is an object of the invention to provide a firearm muzzle end portion complete sight and mount that is easily used by shooters of all ages and shooting experience.

It is an object of the invention to provide a firearm muzzle end portion complete sight and mount that can be easily used by shooters whose eye focusing ability is impaired.

It is an object of the invention to provide a firearm muzzle end portion complete sight and mount that can be easily used by shooters that use corrective lenses.

It is an object of the invention to provide a firearm muzzle end portion complete sight and mount where the mount can be integrated with the sight.

It is an object of the invention to provide a firearm muzzle end portion complete sight and mount where the mount can be separate from the sight.

It is an object of the invention to provide a firearm muzzle end portion complete sight and mount that is very rugged.

It is an object of the invention to provide a firearm muzzle end portion complete sight and mount that is easy to manufacture.

It is an object of the invention to provide a firearm muzzle end portion complete sight and mount that is inexpensive to manufacture.

It is an object of the invention to provide a firearm muzzle end portion complete sight and mount that allows a novice shooter to learn to shoot more accurately and rapidly than with conventional sights.

It is an object of the invention to provide a firearm muzzle end portion complete sight and mount that allows a shooter to shoot with both eyes open which is desired for rapid and accurate shooting.

These and other objects of the firearm muzzle end portion complete sight and mount will become apparent from the following described invention that includes a light weight scope with an artificially illuminated reticle and scope mount adapted to be mounted on the muzzle end portion of a firearm barrel. The scope has an internal source of energy to provide for the artificial illumination of the scope reticle. The invention also has attaching means for rapidly attaching and removing the sight and mount to and from the muzzle end portion of the firearm barrel without requiring modification of the firearm. Both the scope and mount are specifically designed to make them extremely light in weight and not to damage or mar the finish of the firearm barrel.

BRIEF DESCRIPTION OF THE DRAWINGS

The invention will be hereinafter more fully described with reference to the accompanying drawings in which.

DETAILED DESCRIPTION OF THE PREFERRED EMBODIMENTS

Figure 1:
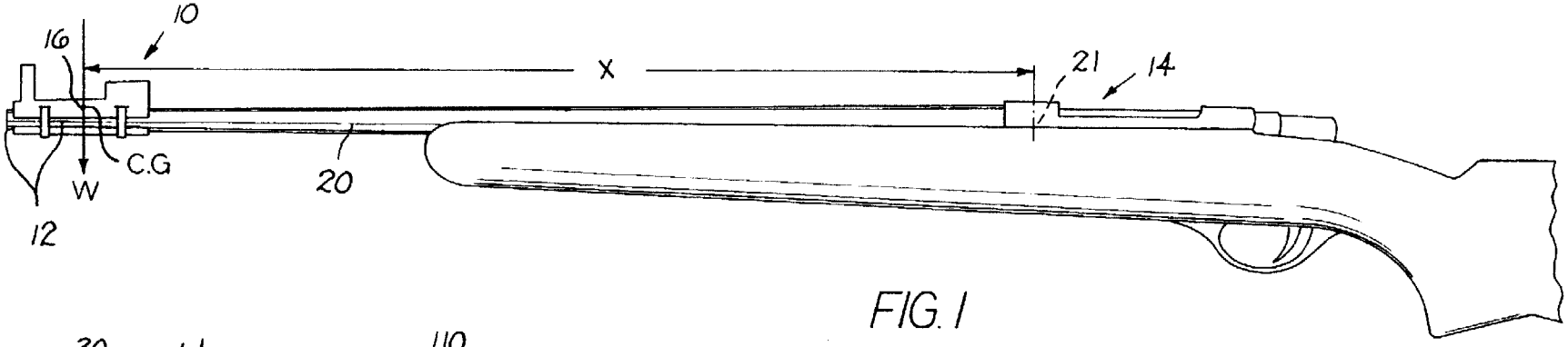
FIG. 1 is a side elevational view of a rifle illustrating the firearm barrel muzzle end portion complete sight and mount invention in use on the muzzle end portion of the barrel of the rifle.

Referring first to FIG. 1, the firearm barrel muzzle end portion mounted complete firearm sight and mount is illustrated and is designated generally by the number 10. As illustrated, the combined sight and mount 10 is shown attached or mounted on the muzzle end barrel portion 12 of a small arm firearm designated generally by the number 14, which in this case is a rifle. It should be understood that the sight and mount invention can be mounted on any type of small arm firearm including, but not limited to rifles, carbines, shotguns, machineguns, submachineguns, long barreled pistols and revolvers and the like and any reference herein to small arm or small arm firearm or firearms or small arm firearm or small arm firearms is meant to include all of these types of weapons or firearms. It will be noted in FIG. 1, that the center of gravity C.G., designated by the number 16, of the sight and mount 10 is illustrated as being a distance X from the breech end of the rifle barrel 20 that is designated by the number 21. The significance of this distance X and the center of gravity C.G. 16 as well as the weight, represented by the letter W of the sight and mount 10 will be hereinafter described in detail.

Figure 2:
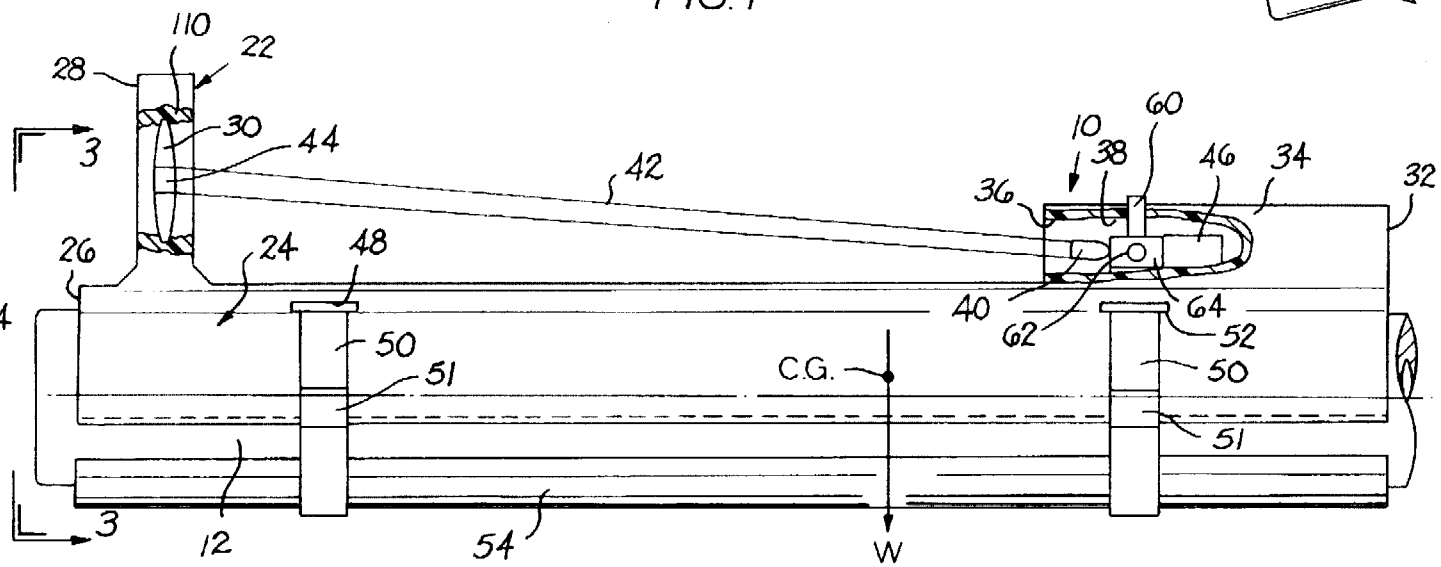
FIG. 2 is an enlarged side elevational view of the sight and mount that can be mounted on the firearm barrel muzzle end portion as set forth in FIG. 1 with portions thereof broken away for ease of illustration.
Figure 3:
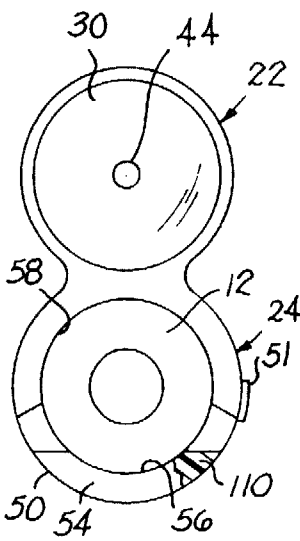
FIG. 3 is a front elevational view of the sight and mount structure set forth in FIG. 2 taken in the direction 3—3 thereof.

FIGS. 2 and 3 illustrate an enlarged view of the sight and mount 10 set forth in FIG. 1 with portions thereof broken away for clarity. It should be noted that the optical sight portion 22 is integral with the sight mount portion 24 and that both of these portions 22 and 24 are made from a suitable plastic material that in the preferred embodiment is Acital, ABS, or polyethylene and graphite compositions and any reference herein to plastic shall mean such a material or materials unless specifically stated or modified by appropriate qualifying language. As illustrated in FIG. 2, the forward or muzzle pointing end 26 of the sight and mount 10 has a substantially circular hollow ring shaped member portion 28 that holds an optical lens 30 that is made from optical quality plastic materials. Located at the opposite mount end portion from the portion 24 is the breech or rear pointing portion 32. The sight portion on this rear pointing portion 32 has a hollow housing 34 with an opening 36 and a hollow interior 38. A light emitting diode or the like 40 is located in position within the interior 38 to project a light beam 42 so that an illuminated dot 44 appears on the lens 30. The diode or the like 40 is electrically connected to and is powered by a battery 46 that is also located in the cavity or hollow interior 38, or elsewhere at a suitable location.

As illustrated in FIG. 2, the upper portion of the muzzle end 26 of the mount portion 24 has a generally rectangular shaped slot 48 that extends through the mount portion 24 that is sized and shaped to receive a mounting band 50. In a similar manner, the breech or rear pointing portion 32 also has a generally rectangular slot 52 located in and that extends through the upper portion of the mount portion 24 and this slot 52 is also sized and shaped to also receive another mounting band 50. Each strap or mounting band 50 has a closing or fastening device designated by the number 51. The sight and mount invention 10 also includes an elongated member 54 whose length is substantially equal to the length of the sight portion 24 that is sized and shaped to be located below the firearm barrel muzzle end portion 12.

As best illustrated in FIG. 3, the elongated member 54 has a cross section that forms part of a portion of a circular shaped ring and its interior surface 56 is shaped to substantially conform to the exterior of the muzzle end barrel portion 12. The same is true with the interior surface 58 of the sight mount portion 24 in that the interior surface 58 is also shaped to substantially conform to the exterior of the muzzle end barrel portion 12. The elongated member 54 is made from the same type of plastic material as the integral optical sight and mount 10. Both the elongated member 54 and the bands 50 serve to clamp the optical sight portion 22 With the integral sight mount portion 24 to the muzzle end barrel portion 12. It should be noted in FIG. 3 that both elevation and windage are provided respectively by the threaded screws 60 and 62 that are threaded into respective threaded holes in a diode base 64 that rigidly mounts the light emitting diode 40.

Figure 4:
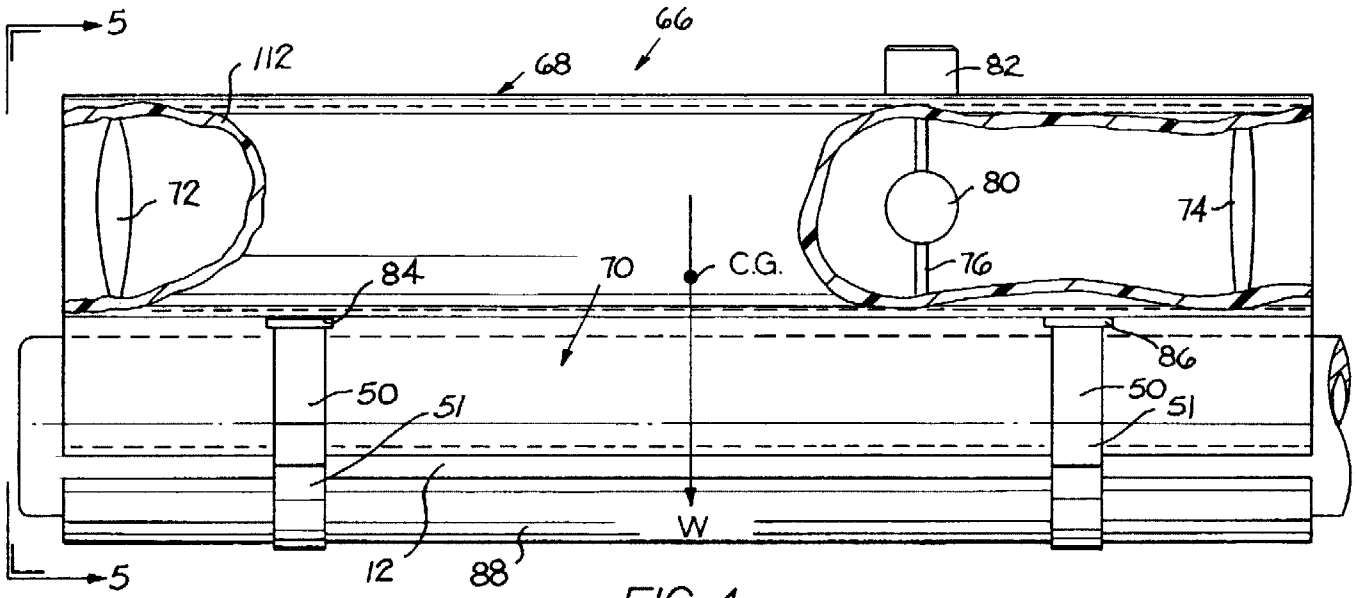
FIG. 4 is a side elevational view of an additional embodiment of the sight and mount invention with portions thereof broken away for ease of illustration.
Figure 5:
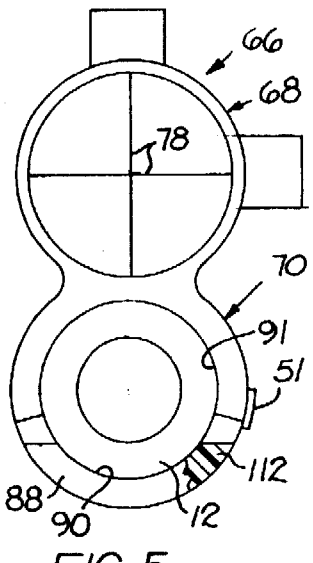
FIG. 5 is a front elevational view of the sight and mount invention set forth in FIG. 4 taken in the direction 5—5 thereof.

FIGS. 4 and 5 illustrate another embodiment of the firearm barrel muzzle portion mounted complete firearm sight and mount that is designated generally by the number 66. This combination optical sight and sight mount 66 has a hollow tubular sight tube 68 and an elongated semi-circular cross section integral sight mount 70 located adjacent to and below the hollow tubular sight tube 68. Both the sight tube 68 and the sight mount portion 70 are combined together and are made from the same plastic material as the previous embodiment 10 in FIGS. 2 and 3. The sight tube 68 has a plurality of clear optical quality plastic lenses 72 and 74. In addition, the sight tube 68 has a reticle disk 76, or the like, that is made of clear optical quality material that may be a plastic material and has a reticle 78. The term reticle as used herein means any type of device that can be used within a firearm scope sight for aiming or assisting in aiming the firearm including but not limited to dots illusionary or otherwise, rectangles, so called cross hairs, duplex reticles, tapering posts, and any combination of the foregoing. Two adjusting knobs 80 and 82 are provided for respectively adjusting the reticle 78 for windage and elevation. The reticle 78 can be self illuminating to make it easier to see especially at night or during periods of low light or visibility. This can be accomplished by coating the reticle 78 with a florescent material such as tritium or the like in a manner known in the art.

Two rectangular shaped slots 84 and 86 are provided in and extend through the upper portion of the sight mount 70 that are similar to the slots 48 and 52 illustrated in FIG. 2. These slots 84 and 86 are sized and shaped to receive respective mounting bands 50 that are the same as those set forth in FIGS. 2 and 3. An elongated member 88, that is similar to the previously described elongated member 54 in FIGS. 2 and 3, is also provided and this member 88 also has a cross section that forms part of a portion of a circular shaped ring and also its interior surface 90 is shaped to substantially conform to the exterior of the muzzle barrel end portion 12. The same is true with the interior surface 91 of the sight mount portion 70. This elongated member 88 may be made from the same type of plastic as the combined sight tube 68 and the sight mount 70. Both the elongated member 88 and the bands 50 serve to clamp the combined optical sight and sight mount 66 with its tubular sight tube 68 and and elongated semi-circular cross section integral sight mount 70 to the muzzle end barrel portion 12 in a manner similar to for the elongated member 54 and the associated bands 50 set forth in FIGS. 2 and 3.

Figure 6:
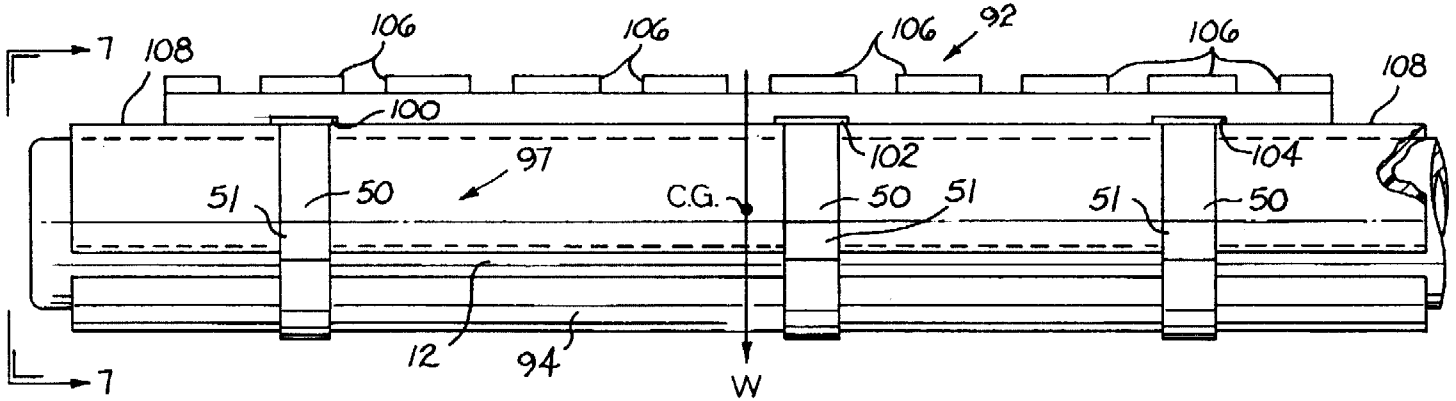
FIG. 6 is a side elevational view of an additional embodiment of the invention but illustrating only the sight mount.
Figure 7:
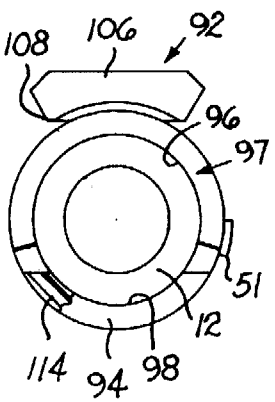
FIG. 7 is a front elevational view of the sight mount invention set forth in FIG. 6 taken in the direction 7—7 thereof.

FIGS. 6 and 7 illustrate a sight mount only without any sight for use on the muzzle end portion 12 that is designated generally by the number 92. An elongated member 94 is also provided for use as part of the mount assembly 92 that is substantially similar to the elongated members 54 and 88 that were previously discussed. Both the curved inner surface 96 of an upper sight mount portion 97 and the curved inner surface 98 of the elongated member 94 are substantially shaped to correspond to the exterior of the muzzle end barrel portion 12. It will also be noted that three substantially rectangular shaped slots 100, 102, and 104 are provided in and extend through the upper portion of the sight mount 92 that are sized and shaped to receive the three mounting bands 50 that were previously described. Both the elongated member 94 and the bands 50 serve to clamp the optical sight mount 92 to the muzzle end barrel portion 12 in a manner similar to the embodiments set forth in FIGS. 2 through 5. The sight mount 92 also includes a series of projections 106 located on the upper surface 108 of the sight mount 92 that are sized and shaped to receive standard type scope mounting rings such as those known as Weaver type rings.

Figure 9:
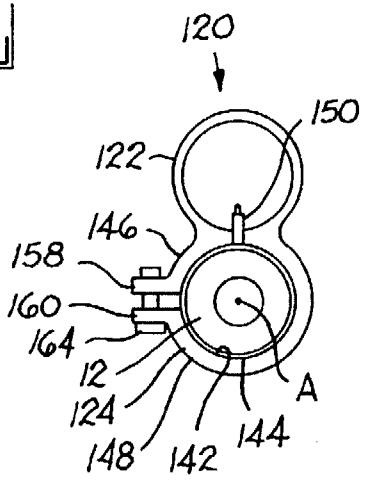
FIG. 9 is a front elevational view of the embodiment of the sight and mount invention set forth in FIG. 8 taken in the direction 9—9 thereof.
Figure 8:
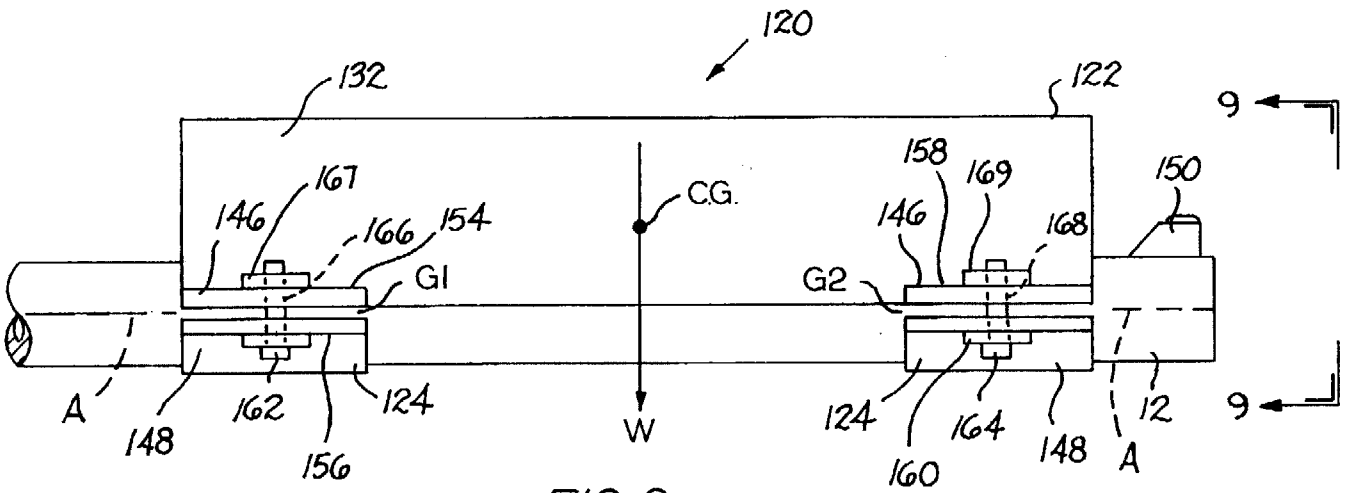
FIG. 8 is a side elevational view of an additional embodiment of the sight and mount invention.
Figure 10:
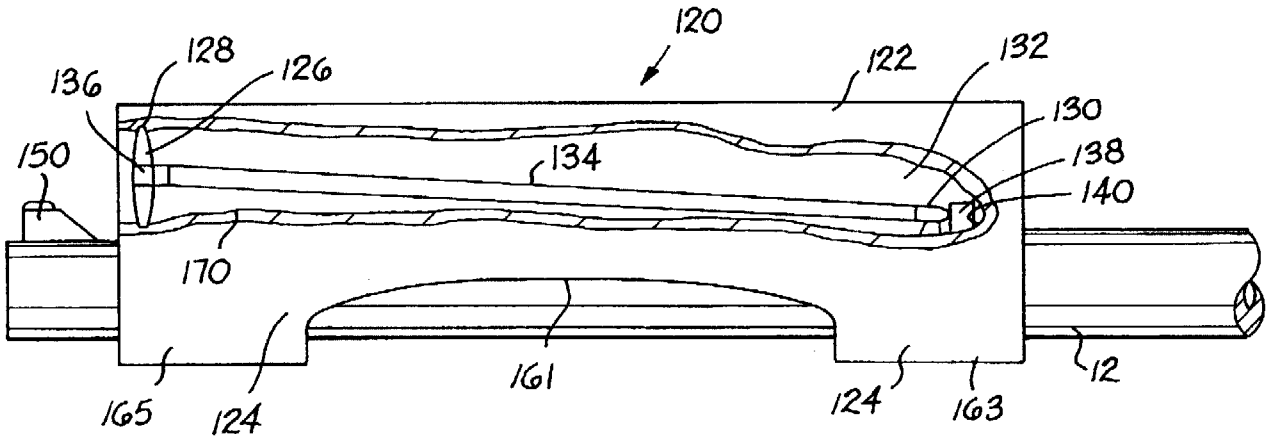
FIG. 10 is a side elevational view of the embodiment of the sight and mount invention set forth in FIGS. 8 and 9, but taken on the opposite side from the side elevational view set forth in FIG. 8.

FIGS. 8 through 10 illustrate another embodiment of the firearm barrel muzzle portion mounted complete firearm sight and mount that is designated generally by the number 120. This combination optical sight and sight mount 120 has a hollow tubular sight tube 122 and an elongated integral sight mount designated generally by the the number 124 located adjacent to and below the hollow tubular sight tube 122. Both the sight tube 122 and the sight mount portion 124 are combined together and are made from the same plastic material as the previous embodiment 10 illustrated in FIGS. 2 and 3 and the previous embodiment 66 set forth in FIGS. 4 and 5.

As illustrated in FIG. 10, the sight tube 122 is cut away to show the internal structural features of the sight tube 122 that are similar to those set forth in FIG. 2 for the embodiment of the invention 10. As illustrated, the sight tube 122 has an optical lens 126 in the interior of its forward portion 128 that is similar to the optical lens 30 illustrated in FIG. 2. In addition, a light emitting diode or the like 130 is located in position within the interior of the rear portion 132 of the sight tube 122 to project a light beam 134 so that an illuminated dot 136 appears on the lens 126. The diode or the like 130 is electrically connected to and is powered by a battery 138 that is located in a cavity 140 in the hollow interior of the rear portion 132, or elsewhere within the sight tube 122 in a manner similar to that for the embodiment set forth in FIG. 2.

As illustrated in FIG. 9, the sight mount portion 124 is substantially cylindrical with a hollow substantially circular shaped interior surface 142 to substantially conform to the outside generally cylindrical surface 144 of the firearm muzzle end barrel portion 12. As best illustrated in FIGS. 8 and 9, the sight mount portion 124 is split or has two portions 146 and 148. The purpose of this split or two portions 146 and 148 is to allow the installation of the sight mount portion 124 on the muzzle end barrel portion 12 even when the muzzle end barrel portion 12 has a fixed or rigid iron front sight such as the fixed sight 150 illustrated in FIGS. 8 through 10. Each of these portions 146 and 148 that provide the split or openings G1 and G2 have two respective spaced apart projecting tab portions 154, 156 and 158, 160 that are located opposite each other as illustrated in FIGS. 8 and 9. As indicated in FIGS. 8, 9 and 10, the the sight mount portion 124 has a portion thereof designated by the number 161 that is cut away or removed so that the sight mount portion 124 is divided into two clamping portions 163 and 165. The removed portion 161 and resulting two clamping portions 163 and 165 comprise means for reducing the weight of the sight mount portion 124 of the combination of the sight and sight mount 120.

The respective tabs 154 and 156 and 158 and 160 of the tab portion pairs are secured to each other by the respective screws 162 and 164. Through the use of these bolts or screws 162 and 164 the respective tab portions are clamped together or biased toward each other. This results in the interior surface 142 of the sight mount portion being clamped against the outside surface 144 of the firearm muzzle end barrel portion 12 to secure the sight mount portion 124 and the combined sight and mount 120 in place on the firearm muzzle end barrel portion 12 as illustrated in FIGS. 8 through 10.

In order to locate the sight and mount 120 on the firearm barrel 12, the bolts or screws 162 and 164 are removed and the combined sight and mount 120 is rotated about the long axis A of the firearm muzzle end barrel portion 12 to a position where the front sight 150 can pass through the resulting respective gaps G1 and G2 located between the tab portions 154 and 156 and 158 and 160 that are illustrated in FIG. 8. Then the combined sight and mount 120 would be pushed onto the muzzle end barrel portion 12 with the sight mount portion 124 surrounding a portion of the muzzle end barrel portion 12 and the front sight 150 would pass through the respective gaps G1 and G2. The combined sight and mount 120 would then be rotated about the long axis A of the firearm muzzle end barrel portion 12 to its desired position and then the bolts or screws 162 and 164 would be inserted into their respective holes 166 and 168 and into their respective nuts 167 and 169 and tightened to secure the combined sight and mount 120 in place on the muzzle end firearm barrel portion 12. Removal of the combined sight and mount 120 would be accomplished by removing the screws 162 and 164 and rotating the combined sight and mount 120 to a position where the front sight 150 could pass through the gaps G1 and G2 and then the combined sight and mount 120 would be pushed or pulled forward and off of the firearm muzzle end firearm barrel portion 12. Consequently, the combined sight 120 and mount is easily and rapidly installed or removed from the firearm muzzle end barrel portion 12.

The previously described firearm barrel muzzle portion mounted self contained or complete firearm sight and mount embodiments 10, 66, 120 and the mount or base 92 are manufactured and used in the following manner. All of the large components of the sight and mount are made from a light weight plastic that should be high in strength, not affected by oil, water or the like and should not have discernible physical changes when subjected to atmospheric temperature variations. The various lenses should be made from a high grade optical material that can be a clear optical grade plastic that should be shock and abrasion resistant. The mounts and sighting tubes should be made from plastic that in the preferred embodiments has a color additive that will be compatible with the firearm upon which it is intended to be used, or most likely to be used, such as black or silver. This can be accomplished by the inclusion of colored particles such as those designated by the numbers 110, 112, 114 and 170 in the respective firearm sight and mount embodiments 10, 66 and 120 and the mount 92. In the preferred embodiments, the various windage and elevation knobs can also be made of plastic with a color additive to match the scope tube.

With respect to the weight of the sight and mount combination 10, 66, 120 or the sight mount 92 with its sight (not shown), such as that represented by the letter W in FIG. 1, it is important that the weight and the distance X, in inches, from the breech end 21 of the barrel 20 to the center of gravity C. G. of the sight and mount combination 16, such as the combination 10, 66, or 120 be governed by the following equation to determine the maximum weight W for that firearm:

$$W = 10 - L$$

where:

$$L = \frac{X}{8}$$

$W$ = Weight of the scope and mount in ounces $X$ = Distance to center of gravity of sight and mount combination measured in inches from breech end of barrel.

In order to use the embodiments 10 or 66 it is only necessary to attach the appropriate embodiment 10 or 66 to the firearm muzzle end barrel portion 12 by use of the appropriate mounting bands 50 that can be tightened through various means known in the art, such as by screws or clips (not shown). This will cause the appropriate sight mount portion 24 or 70 and the associated elongated members 54 and 88 to conform to the outside surface of the muzzle end barrel portion 12 at or near the location of the bands 50. The same is true with respect to the mount or base 92 and its elongated member 94 and the associated mounting bands 50 and the firearm muzzle end barrel portion 12. In order to use the embodiment 120 it is only necessary to attach the combined sight and mount 120 to the firearm muzzle end barrel portion 12 by use of the the bolts or screws 162 and 164 in the previously indicated manner. Since only plastic comes into contact with the firearm muzzle end barrel portion 12 in all of the embodiments, marring of the finish of the muzzle end barrel portion 12 is completely avoided.

Although the invention has been described in considerable detail with reference to certain preferred embodiments, it will be appreciated and understood that various changes and modifications may be made without departing from the spirit and scope of the invention as defined in the appended claims.

What is claimed is:

1. A firearm optical sight and mount for use on a firearm that has both a breech end and a muzzle end portion of a barrel for mounting an optical sight and mount on said muzzle end portion of said barrel comprising an optical generally tubular sight and mount for mounting said optical generally tubular shaped sight and mount on said muzzle end portion of said barrel of said firearm, said optical sight and mount having means for making said optical sight and mount light in weight comprising primarily a non-metallic material and the maximum weight W of said optical sight and mount is determined in accordance with the following:

$$W = 10 - L$$

where:

$$L = \frac{X}{8}$$

$W$ = Weight of said optical sight and mount in ounces $X$ = Distance to center of gravity of said optical sight and mount measured in inches from said breech end of said barrel.

2. The firearm optical sight and mount of claim 1 wherein said optical sight has a reticle.

3. The firearm optical sight and mount claim 2 wherein said reticle is illuminated.

4. The firearm optical sight and mount of claim 3 wherein said mount comprises means for rapidly mounting said optical sight and mount on and removing said sight and mount from the muzzle end portion of said barrel of said firearm.

5. The firearm optical sight and mount of claim 4 wherein said mounting means comprises means for mounting said optical sight and mount on said muzzle end portion of the barrel of said firearm without altering said firearm.

6. The firearm optical sight and mount of claim 1 wherein said mount comprises a member sized and shaped to be located below the muzzle end portion of said barrel of said firearm.

7. The firearm optical sight and mount of claim 6 wherein said mounting means further comprises at least one clamp for clamping said optical sight and mount to said muzzle end portion of said firearm barrel.

* * * * *